US005479859A

United States Patent [19]

Lindner et al.

[11] Patent Number: 5,479,859

[45] Date of Patent: Jan. 2, 1996

[54] METHOD AND APPARATUS FOR CONTROLLING THE AUTOMATED CHANGING OF PRINTING PLATES IN PRINTING MACHINES

[75] Inventors: Bernd Lindner; Nikola Pupic, both of Heusenstamm; Helmut Schild, Steinbach/Ts.; Berthold Seib, Rodgau; Thomas Moller, Neuhof-Rommerz, all of Germany

[73] Assignee: MAN Roland Druckmaschinen AG, Germany

[21] Appl. No.: 338,908

[22] Filed: Nov. 14, 1994

[30] Foreign Application Priority Data

Nov. 12, 1993 [DE] Germany ..... 43 38 664.4

[51] Int. Cl.[6] ..... B41L 3/02

[52] U.S. Cl. ..... 101/485; 101/477; 101/415.1; 101/DIG. 36; 33/621

[58] Field of Search ..... 101/415.1, 477, 101/484, 485, 486, DIG. 36; 33/614, 617, 618, 619, 621, 623

[56] References Cited

U.S. PATENT DOCUMENTS

| | | | |
|---|---|---|---|
| 4,437,407 | 3/1984 | Wirz et al. | 101/415.1 |
| 4,603,641 | 8/1986 | Jeschke et al. | 101/415.1 |
| 5,111,744 | 5/1992 | Wieland | 101/216 |
| 5,331,892 | 7/1994 | Seib et al. | 101/377 |
| 5,383,402 | 1/1995 | Takano et al. | 101/477 X |
| 5,390,603 | 2/1995 | Hauck et al. | 101/485 |

FOREIGN PATENT DOCUMENTS

| | | | |
|---|---|---|---|
| 0195848 | 10/1986 | European Pat. Off. | 101/415.1 |
| 0555782A1 | 8/1993 | European Pat. Off. . | |
| 3019595 | 11/1981 | Germany | 101/415.1 |
| 3940796C2 | 6/1991 | Germany . | |
| 4130359A1 | 9/1991 | Germany . | |
| 0019458 | 1/1987 | Japan | 101/415.1 |
| 0193114 | 8/1993 | Japan | 101/415.1 |

OTHER PUBLICATIONS

*Druckwelt* (Printing World) 4/25.02.193, p. 24 ff.

*Primary Examiner*—Chris A. Bennett

*Attorney, Agent, or Firm*—Leydig, Voit & Mayer, Ltd.

[57] ABSTRACT

A method and an apparatus for controlling an automated printing plate change process in a sheet-fed offset printing machine, in which a used printing plate is removed from the gripping portion of a clamping rail allocated to the leading edge of the plate cylinder and thereupon a new printing plate is guided into the opened gripping portion. Position sensors are used to determine, first, whether the front end of the used printing plate, and subsequently, whether the front end of the new printing plate, is in register in the leading edge clamping rail. Such information is used to control the plate change process. During the plate change process, the sensors are interrogated to determine whether the used plate has been removed from the plate cylinder, and whether the new printing plate is properly loaded.

9 Claims, 3 Drawing Sheets

METHOD AND APPARATUS FOR CONTROLLING THE AUTOMATED CHANGING OF PRINTING PLATES IN PRINTING MACHINES

FIELD OF THE INVENTION

The invention relates to printing machines and in particular to methods and apparatuses for controlling the automated changing of printing plates.

BACKGROUND OF THE INVENTION

In sheet-fed offset printing machines, a printing plate is fastened onto the plate cylinder by means of a clamping rail adjacent to the leading edge (LE) of the plate cylinder and another clamping rail adjacent to the trailing edge (TE). Typically, these clamping rails are arranged in a pit on the plate cylinder. To change a printing plate, the clamping rail at the trailing edge is first opened and the printing plate is progressively separated from the plate cylinder by rotating the latter backwards, until only the front edge portion of the plate remains in contact with the cylinder. Then, the clamping rail at the leading edge is opened and the plate is removed. Next, a new printing plate is laid with its front edge in the leading edge clamping rail. After proper alignment, the front edge of the new plate is clamped by closing the leading edge clamping rail, and the plate cylinder is then rotated in the forward direction until the rear edge of the printing plate can be fed into the trailing edge clamping rail and clamped there. The tensioning of the printing plate is carried out via the trailing edge clamping rail.

In conventional printing machines, these steps are carried out manually by the operator and are correspondingly time-consuming. In order to shorten the setting-up time, automatic or semi-automatic printing plate change systems have recently become known, in which the used printing plate is taken from the plate cylinder into a magazine or a storage chamber and a new printing plate is taken from this same magazine or storage chamber and fed to the plate cylinder. For this purpose, the plate cylinder has devices with which the clamping and tensioning processes can be initiated by remote control.

German Patent DE 4 130 359 A2 discloses a device and a method for changing printing plates of a printing machine, in which the printing plate change can be carried out both semi-automatically and fully automatically. In the semi-automatic mode of operation, it is provided that the operator controls the change process by actuation of multiple operating elements. Due to the number of partial processes to be initiated in order to carry out the plate change, this method and the corresponding device can be quite costly.

Disclosed in U.S. Pat. No. 5,111,744 (and corresponding German Patent DE 3 940 796 C2) is a method and a device for the automatic changing of a printing plate, in which a so-called position detector determines the in-register laying of the printing plate in the leading edge rail, whereupon clamping is initiated.

Determining the in-register position by means of register pins insulated electrically with respect to the plate cylinder and which interact with corresponding stamped-out regions in a printing plate, is disclosed in European Patent EP 0 555 782 A1. If the printing plate is lying with its stamped-out regions positioned correctly on these register pins, a current loop is closed. This is detected and used to determine when the plate is properly positioned.

A printing plate draw-in system operating semiautomatically is known under the designation PPL (Power Plate Loading) from the firm MAN Roland Druckmaschinen AG and is in use on machines of the series R 700. This device is demonstrated in the German magazine Druckwelt (Printing World) 4/25.02.1993, page 24 ff, and is further described in German Patent Application DE 4 215 969 A1and the corresponding U.S. Pat. No. 5,331,892. In this device, the operator only removes a printing plate, separated from the plate cylinder, through a slit in the sliding guard and feeds a new printing plate to the plate cylinder. For this purpose, the system is provided with a pneumatically movable sliding guard having a guide device which can be pivoted in and out relative to the plate cylinder. The remotely actuated clamping and unclamping and the corresponding positioning processes of the plate cylinder are initiated in this system by the operator via operating elements.

SUMMARY OF THE INVENTION

It is the object of the present invention to develop a method and a device which, in the case of a semiautomatic printing plate change process, minimizes the number of commands to be input by the operator on the control unit and, furthermore, provides an increased immunity from interference in the case of a fully automatic printing plate change process.

In this respect, it is a feature of the present invention to use interrogatable position sensors to detect whether a front edge of a printing plate is assuming an in-register position in the leading edge clamping rail of the plate cylinder, and use such information to control the entire plate change process. Incorporating in the control procedure the steps of determining, by means of position sensors, whether a plate is assuming an in-register position results in a simpler and safer printing plate change process.

According to a preferred embodiment of the invention, position sensors, such as electrically interrogatable register pins, are used not only for the purpose of determining whether a printing plate to be newly fed has been laid in register in the leading edge clamping rail, whereupon the clamping process is initiated, but also to determine whether a used printing plate has been taken out of the leading edge clamping rail after the clamping is released.

It is a further feature of the method according to the present invention that after it has been determined that a new printing plate is lying correctly on the register pins, the clamping process is initiated and subsequently a renewed interrogation of the register pins is undertaken. By means of this renewed interrogation it can be determined whether any position displacement has resulted due to the clamping of the printing plate.

As another development according to the invention, it can be provided that the position sensors can be interrogated individually. By doing so, it is possible to determine which part of the front edge of the printing plate is not lying in register. The status of the position sensors can be indicated to the operator by means of visual displays, such as light-emitting diodes, or acoustic means, such as beeping sounds.

Other objects and advantages of the invention will become apparent from the following detailed description when taken in conjunction with the drawings, in which:

DETAILED DESCRIPTION OF THE PREFERRED EMBODIMENT

While the invention will be described in connection with a particular embodiment, there is no intent to limit it to this embodiment. On the contrary, the intent is to cover all alternatives, modifications, and equivalents included within the spirit and scope of the invention as defined by the appended claims.

Figure 1:
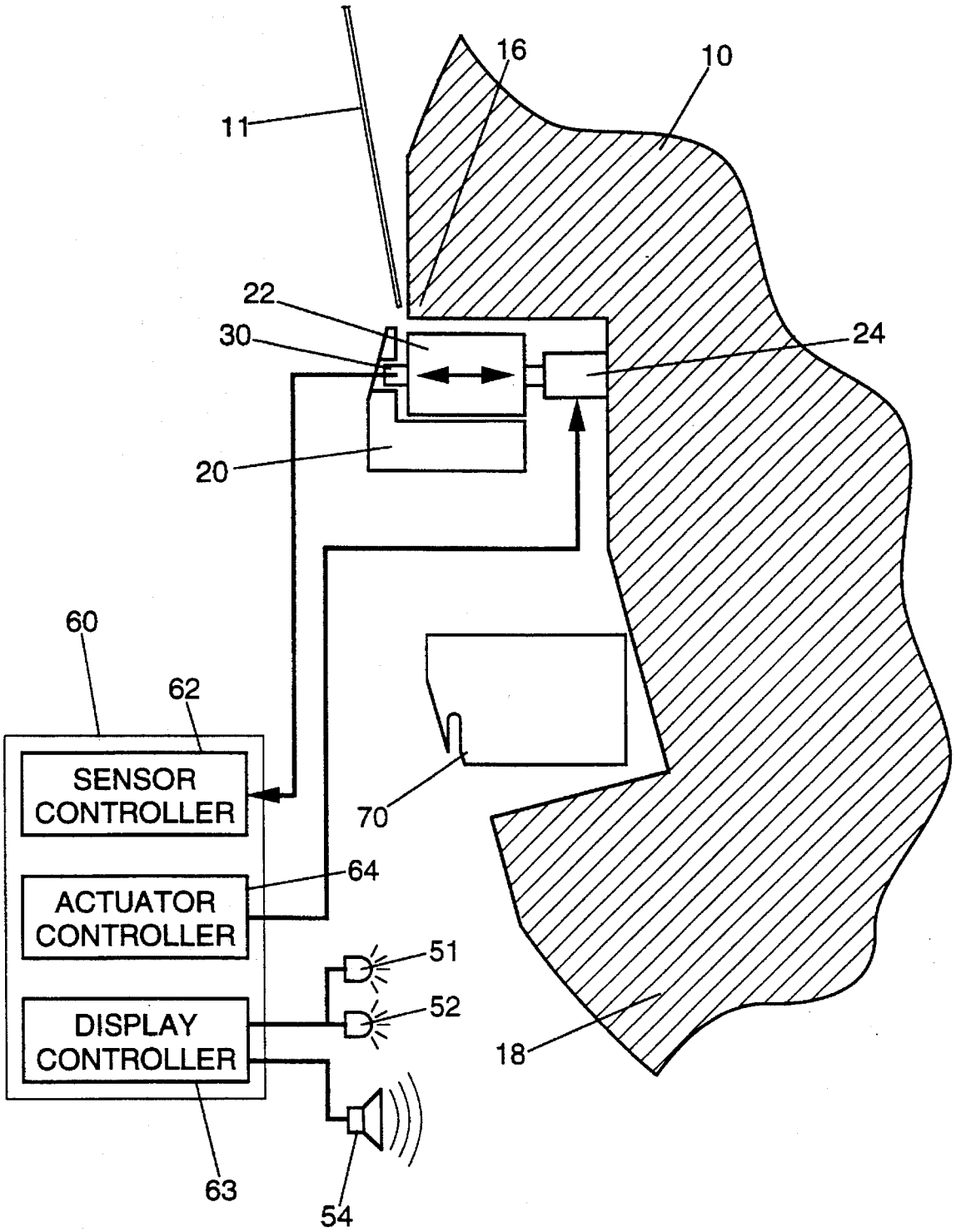
FIG. 1 shows, in a cross sectional view, a plate cylinder with interrogatable register pins on the gripping portion of the leading edge clamping rail, and a block diagram of a control unit for controlling the plate change process.

Turning now to the figures, FIG. 1 shows an embodiment of the apparatus according to the present invention for controlling the changing of printing plates on an offset printing machine. The plate cylinder 10 and the clamping rails 20, 70 are shown in cross section. The plate cylinder 10 has a leading edge 16 (print start edge) and a trailing edge 18 (print end edge). Between the two edges is a pit. Located in the pit are the leading edge clamping rail 20 and the trailing edge clamping rail 70 positioned, respectively, adjacent to the leading edge 16 and trailing edge 18 of the plate cylinder 10. During a printing operation, a printing plate is clamped in position by the two clamping rails 20, 70. FIG. 1 shows a printing plate 11 to be newly fed into the leading edge clamping rail 20. The leading edge clamping rail 20 has a gripping portion 22 which is movable by an actuator 24. To clamp the front edge 12 (see FIG. 2) of the printing plate 11 in position, the gripping portion 22 is moved outwardly by the actuator 24 toward the clamping rail 20 and held in a "closed" position. To allow removal of a used plate and insertion of a new plate, the gripping portion 22 is moved away from the clamping rail 20 and held in an "open" position.

Proper alignment of a printing plate on the plate cylinder 10 is essential to high quality printing. According to the present invention, interrogatable position sensors are used to detect whether the printing plate is assuming an in-register position, i.e., properly positioned and aligned on the plate cylinder.

Figure 2:
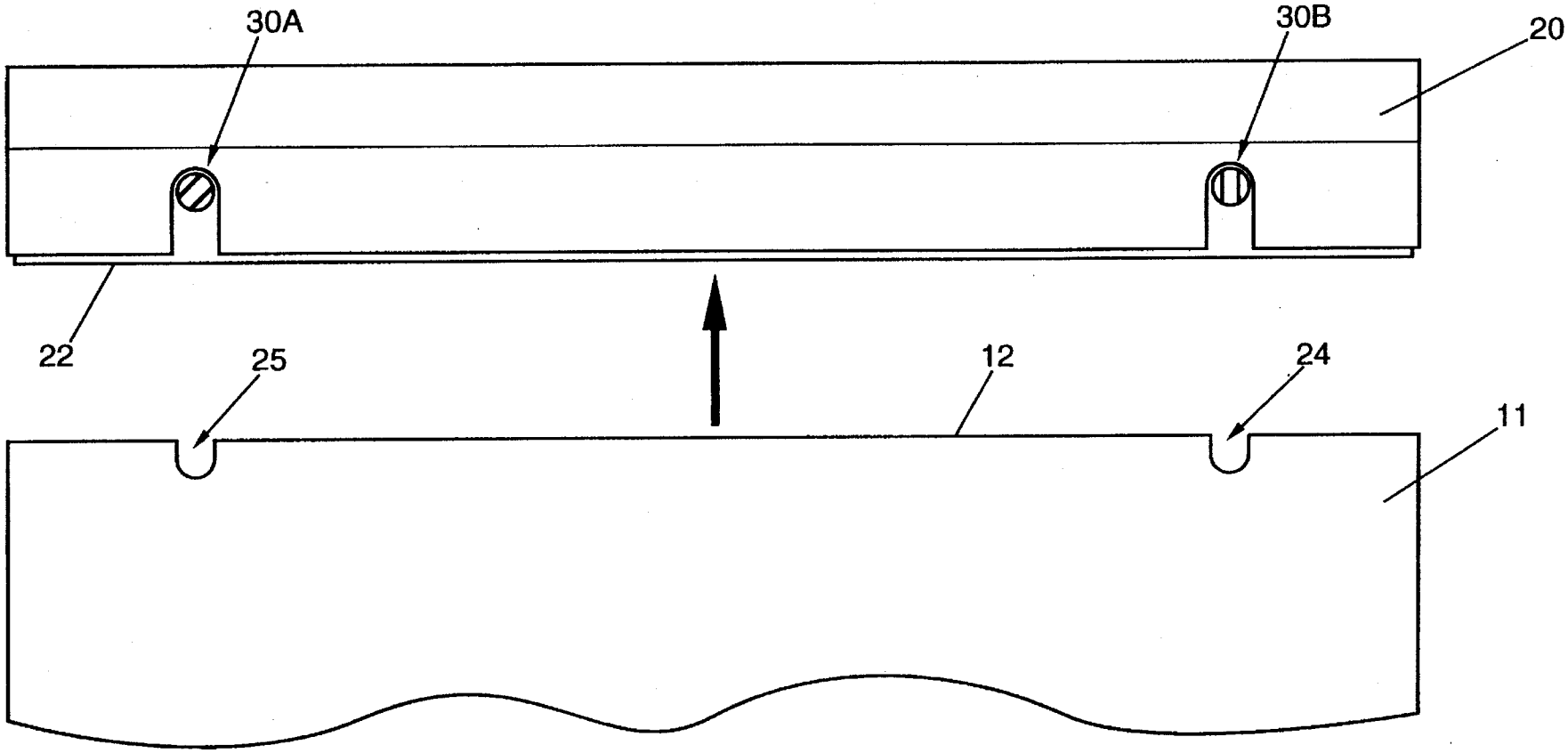
FIG. 2 shows a top view of the leading edge clamping rail and the register pins.

In the preferred embodiment, special register pins 30 are used as position sensors. The register pins 30 are mounted on the gripping portion 22 of the leading edge clamping rail 20, and are electrically insulated from the gripping portion. FIG. 2 shows a top view of the clamping rail 20 and two register pins 30A, 30B. The clamping rail 20 has cut-out regions corresponding to the location of the register pins 30A, 30B so that the pins do not contact the clamping rail. Neither of the register pins 30A, 30B is, therefore, electrically connected to either the clamping rail 20 or the gripping portion 22 when there is no printing plate in position.

The register pins 30A, 30B serve as mechanical means for ensuring proper alignment of a printing plate 11 on the plate cylinder 10. As shown in FIG. 2, the front edge 12 of the printing plate has stamped-out portions or notches 24, 25. The separation between the notches 24, 25 is the same as the spacing between the register pins 30A, 30B. When the front edge 12 of the printing plate is properly aligned and inserted into the space between the leading edge clamping rail 20 and the gripping portion 22, the notches 24, 25 align with and seat on the outer contours of the register pins 30A, 30B.

The register pins 30A, 30B also serve an electrical function in connection with determining whether a printing plate is assuming an in-register position. As indicated previously, the register pins are electrically insulated from both the clamping rail 20 and the gripping portion 22. When the plate 11 is in proper register, the bottom edges of notches 24, 25 on the printing plate 11 seat on and contact the register pins 30A, 30B, thus providing a conductive path from the register pins to the gripping portion 22. By sensing whether such a conductive path is formed for each register pin 30A, 30B, it can be determined whether the printing plate 11 is in proper register.

Returning now to FIG. 1, according to the present invention a control unit 60 controls the printing plate change process. The control unit may be located next to a printing machine and control only that machine, or it be a central control station controlling many printing machines. The control unit, based upon the functions it performs in the plate change process, can be viewed as comprising several functional sub-units. As shown in FIG. 1, the control unit 60 has a position sensor controller 62 (to which the register pins 30 are connected). The sensor controller 62 comprises an electronic circuit which, in well-known fashion, interrogates the pins 30 to determine whether the plate 11 is assuming an in-register position. In a preferred embodiment, each of the register pins 30 is connected separately to the position sensor controller 62 so that they can be interrogated individually. By detecting whether there is a short circuit between each of the register pins 30 and the gripping portion 22, it can be determined whether the entire front edge 12 of the plate, or only a portion of it, is assuming an in-register position. The position sensor controller 62 generates signals indicating whether or not the register pins are in electrical contact with the printing plate 11.

Also shown in FIG. 1 is an in-register indicator 63, which indicates to the operator of the plate change process the positioned status of a printing plate in relation to the register pins 30. The indication can be by visual means. For example, FIG. 1 shows two light emitting diodes (LED) 51, 52, the on/off state of each LED corresponding to the closed/open state of the conductive path between one of the register pins 30 and the leading edge clamping rail 20. The in-register indication can also be made by audio means, such as a sound transducer 54.

The control unit 60 also has an actuator controller 64, which controls the actuator 24 to open or close the gripping portion 22 of the leading edge clamp rail 20. Signals provided by the position sensor controller 62 are used by the actuator controller 64 to determine whether the gripping portion 22 should be opened or closed.

Figure 3:
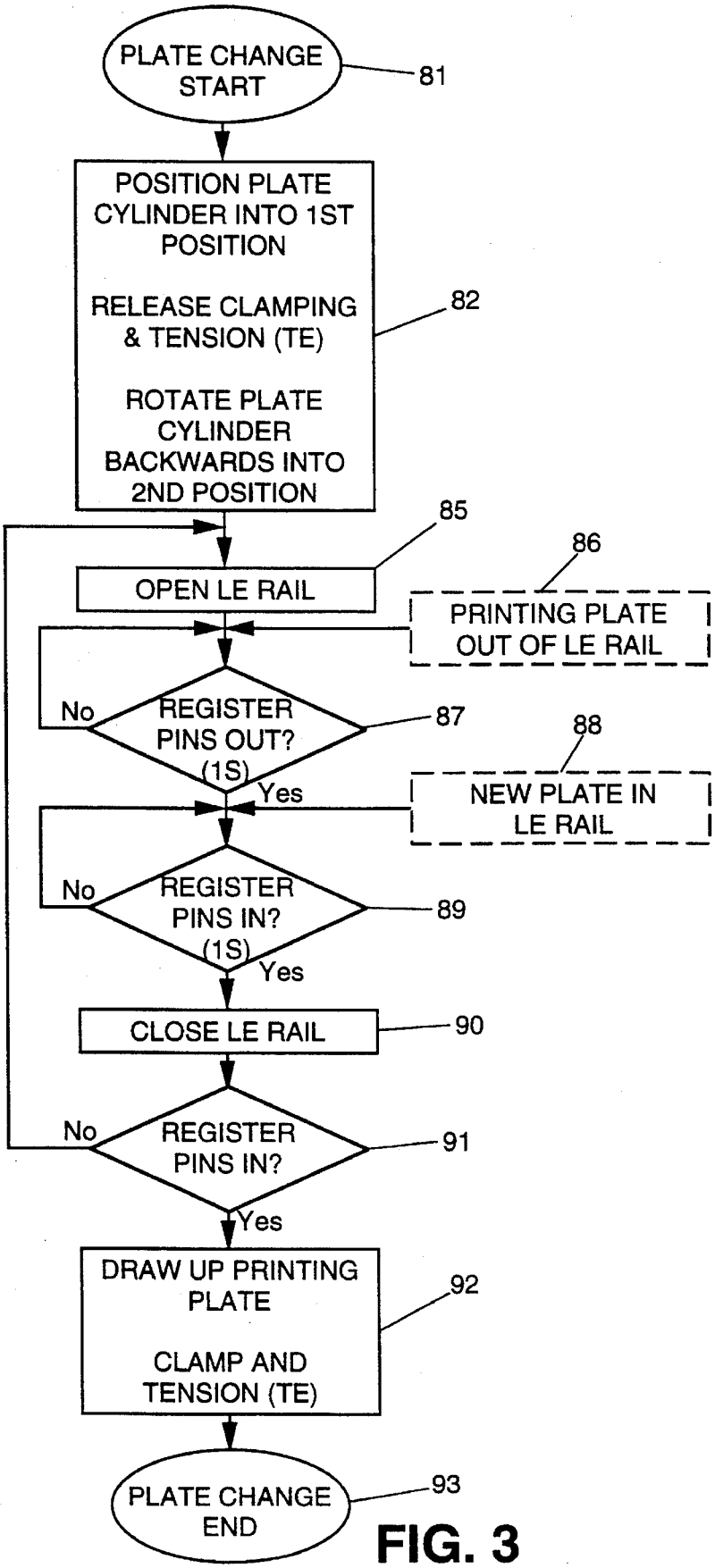
FIG. 3 is a flow chart illustrating the preferred method for controlling the printing plate change process according to the present invention.

FIG. 3 is a flow chart illustrating the preferred method for controlling the plate change process according to the present invention. To assist in understanding the method, FIG. 3 should be considered in conjunction with FIG. 1. To initiate the plate change process, a "plate change start" command is entered by actuating a corresponding command key (step 81).

Thereafter, some common security interrogations (not shown in FIG. 3) are carried out, especially whether the safety guards are closed, etc. Also, a blocking of the machine control to specific commands is carried out so that the printing machine can no longer be driven from another control unit at another location.

The plate cylinder 10 is then (step 82) positioned in a first predetermined angular position, which is carried out by driving it in the forward or backward direction. After the plate cylinder 10 is in the first predetermined angular position, the clamping of the old plate at the trailing edge (TE) clamping rail 70 is released by means of the corresponding positioning means.

After the clamping at the trailing edge 70 is released, the plate cylinder 10 is slowly rotated backwards until a second predetermined angular position is reached and the used printing plate is delivered with its rear edge leading. The plate can be delivered, for example, into an automatic printing plate changer or into a pick-up device for manual removal. Since the diagram of FIG. 3 is primarily for understanding the control method of the present invention, common procedures to be initiated for putting into place or removing pressure rolls or a pressure plate magazine have not been shown.

At step 85, after the plate cylinder 10 has reached the second predetermined angular position, opening of the leading edge (LE) clamping rail 20 is carried out by controlling the actuator 24 to move the gripping portion 22 away from the clamping rail 20. Clamping of the plate 11 is thus released. An interrogation of the register pins 30 is then carried out (step 87). By doing so, it is determined whether the printing plate is still in electrical contact with either or both of the register pins.

If the plate remains in contact (i.e., not out of contact) with either of the register pins, the programmed sequence is interrupted at this point by means of continuous further interrogation. In particular, it is preferred that this interrogation is carried out over a prescribed interval, e.g., one second (1S). Only when both register pins 30 maintain no contact with the printing plate for at least this time interval is the remainder of the program sequence carried out.

Because of its intrinsic weight, the printing plate will typically lie on one or both of the register pins 30 in the case of an "opened" leading edge clamping rail before it is engaged for removal. By means of the last described interrogation of whether the register pins are inactive (not contacted by the printing plate), it is determined whether the printing plate has been physically removed. This removal is shown in the flow chart of FIG. 3 by means of the dashed outlining of the corresponding step 86. It does not matter whether the printing plate is drawn manually out of the leading edge (LE) clamping rail 20 or conveyed away by automated conveying means.

The second predetermined angular position of the plate cylinder is also the position maintained for feeding the front edge 12 of a new printing plate 11 into the leading edge clamping rail 20. If, by means of the last-described interrogation of the register pins 30 (step 87), it was determined that the used printing plate had been removed, a further interrogation (step 89) is then carried out as to whether a new printing plate 11 has been fed into and properly aligned by the leading edge clamping rail 20. If a positive interrogation results for a prescribed time interval, e.g, 1 second (1S), it is evaluated as an indication that the printing plate is lying correctly in place. If the prescribed criterion is not fulfilled, the interrogation of step 89 is repeated until this is the case. When this criterion is fulfilled, the leading edge (LE) clamping rail is closed (step 90). The printing plate 11 is thus clamped at its front edge.

There next follows a renewed interrogation of the register pins 30 (step 91). It is thereby determined whether the printing plate 11 is still positioned properly on the register pins after the clamping step 90. If this is not the case, the program reverts to step 85, which causes the leading edge clamping rail 20 to again be opened. Once the leading edge clamping rail is opened, the printing plate is removed from the region of the register pins and then re-laid.

If, after clamping (step 90), an in-register position of the printing plate 11 is determined (step 91), the printing plate is then drawn up around the plate cylinder by means of forward rotation of the plate cylinder (step 92). Thereafter, the guiding of the rear edge of the printing plate into the trailing edge (TE) clamping rail 70, and the clamping and tensioning of the printing plate are carried out. The removal of any external devices placed on the plate cylinder during the drawing-up process is then carried out. After all the steps provided have been carried out, the printing plate change sequence is terminated (step 93).

The foregoing describes a plate change on one printing unit. In a printing system with more than one printing unit, the same process is carried out on the other printing units. It can be provided that the operator initiates the change of plate on each printing unit via actuation of one or more keys. As can be seen, no further commands are necessary on a printing unit during the change process.

The procedure of the invention turns out to be very advantageous in the case of a multicolor machine, since the command "plate change start" only need be given once. The control unit is thus programmed in such a way that, after the end of the plate change in the first printing unit, the corresponding processes and the positioning of the plate cylinder in the following printing units are initiated immediately. Because of the interrogation according to the invention, the control sequence is interrupted until the new plate has been properly fed.

It will be appreciated that what is provided is a simplified method and the corresponding apparatus for controlling the plate change process of a printing machine. Position sensors are used to determine whether a printing plate is assuming an in-register position. Such information is used to determine both whether a used plate has been removed from the plate cylinder and whether a new plate has been inserted and properly aligned in the leading edge clamping rail. Incorporating in the control procedure the steps of determining whether the plate is assuming the in-register position results in simpler and safer printing plate change process.

What is claimed is:

1. A method for controlling the changing of a printing plate in a printing machine having a plate cylinder, the printing plate having a front edge to be held in position by a gripping portion of a leading edge clamping rail mounted on the plate cylinder, whereby a used printing plate is removed from the opened gripping portion of the leading edge clamping rail and a new printing plate is subsequently inserted into the opened gripping portion, said method comprising of the steps of:

providing position sensors responsive to the position of the front edge of a printing plate, said sensors being interrogatable for determining whether a front edge of a printing plate is in an in-register position in the gripping portion of the leading edge clamping rail;

opening the gripping portion of the leading edge clamping rail;

drawing the used printing plate away from the gripping portion;

interrogating the position sensors to determine whether the front edge of the used printing plate is in an in-register position, such interrogation continuing and subsequent steps of the plate change method being suspended until it is determined that the used printing plate is no longer in register;

feeding the front edge of a new printing plate into the opened gripping portion of the leading edge clamping rail;

interrogating the position sensors to determine whether the front edge of the new printing plate is in an in-register position, such interrogation continuing and subsequent steps of the plate change method being suspended until it is determined that the new printing plate is in register; and closing the gripping portion of the leading edge clamping rail.

2. The method of claim 1, wherein the determination as to whether the front edge of a printing plate is in an in-register position or not is carried out using two conductive points of the leading edge clamping rail spaced axially from each other.

3. The method of claim 1, wherein the determination as to whether the front edge of a printing plate is in an in-register position is carried out using two register pins spaced axially from each other, each being individually interrogatable.

4. The method of claim 1, wherein the determination as to whether the front edge of a printing plate is in an in-register position or not is carried out within a predetermined time interval.

5. The method of claim 1, wherein, after closing the gripping portion of the leading edge clamping rail, a further determination is made as to whether the new printing plate is still in an in-register position and, if the plate is determined to not be in-register, a reopening of the gripping portion is carried out for repositioning the printing plate.

6. An apparatus for controlling the changing of a printing plate in a printing machine having a plate cylinder, whereby a used printing plate is removed from the plate cylinder and a new printing plate is subsequently mounted on the plate cylinder, each of the printing plates having a front edge to be held in position by a gripping portion of a leading edge clamping rail mounted on the plate cylinder, the gripping portion being movable by an actuator to open or close the leading edge clamping rail, the apparatus comprising the combination of:

position sensors responsive to the position of the front edge of a printing plate, the position sensors being interrogatable for determining whether the front edge of a printing plate is in register; and a control unit including:

a sensor controller connected to the position sensors for interrogating the position sensors to determine whether the front edge of a printing plate is in register, the sensor controller generating signals indicating whether the front edge of a printing plate is in register; and an actuator controller responsive to the signals from the sensor controller to control the actuator to open or to close the leading edge clamping rail, wherein, sequentially, the actuator controller opens and holds open the gripping portion of the leading edge clamping rail so as to release the front edge of the used printing plate, the sensor controller interrogates the position sensors repeatedly until it determines that the used plate is no longer in register, after the new plate is inserted the sensor controller repeatedly interrogates the sensors until it determines that the front edge of the new printing plate is in register, and the actuator controller responds to the signals from the sensor controller indicating that the new printing plate is in register and closes the gripping portion of the leading edge clamping rail.

7. The apparatus of claim 6, wherein the position sensors are two electrically interrogatable register pins spaced axially from each other and fitted in the leading edge clamping rail.

8. The apparatus of claim 7, wherein the electrically interrogatable register pins arranged in the clamping rail are connected separately to the control unit.

9. The apparatus of claim 8, wherein an indicator means is provided for indicating which of the register pins the printing plate is contacting.

* * * * *